United States Patent [19]

Merkle

[11] Patent Number: 4,984,670

[45] Date of Patent: Jan. 15, 1991

[54] COIN DROP ASSEMBLY

[75] Inventor: Scott A. Merkle, Newton, Iowa

[73] Assignee: Maytag Corporation, Newton, Iowa

[21] Appl. No.: 304,470

[22] Filed: Feb. 1, 1989

[51] Int. Cl.[5] ..... G07D 5/08

[52] U.S. Cl. ..... 194/317; 194/334

[58] Field of Search ..... 194/317, 318, 319, 334, 194/338

[56] References Cited

U.S. PATENT DOCUMENTS

| | | | |
|---|---|---|---|
| 1,428,632 | 9/1922 | Hendrickson | 194/317 |
| 3,401,780 | 9/1968 | Jullien-Davin | 194/319 |
| 3,732,962 | 5/1973 | Hall | 194/238 |
| 4,361,218 | 11/1982 | Van Dort | 194/317 |
| 4,376,480 | 3/1983 | Abe | 194/323 |
| 4,437,558 | 3/1984 | Nicholson et al. | 194/334 X |
| 4,469,213 | 9/1984 | Nicholson et al. | 194/320 |
| 4,582,189 | 4/1986 | Schmitt | 194/317 |
| 4,676,358 | 6/1987 | Rosendahl | 194/334 X |

*Primary Examiner*—F. J. Bartuska

*Attorney, Agent, or Firm*—Richard L. Ward

[57] ABSTRACT

A compact induction coin drop assembly is provided which includes a coin guide system for guiding horizontally inserted coins rearwardly and downwardly from a coin receiving slot through a predetermined coin test area between the rear of the face plate and rearwardly spaced induction coils associated with coin sensing apparatus. The coin test area includes a coin guide adjacent the rear of the face plate for guiding an inserted coin along a path close to the rear of the face plate. After traversing the coin test area, coins are directed to either a storage receptacle or to a coin return slot in the face plate.

4 Claims, 8 Drawing Sheets

COIN DROP ASSEMBLY

BACKGROUND OF THE INVENTION

This invention relates generally to the field of coin testing and in particular to an improved coin drop assembly. This improved coin drop assembly includes induction coin testing apparatus arranged so that a coin to be tested immediately enters the coin test area along a generally horizontal path. The coin test area is forwardly located between the induction coin testing apparatus and the face plate of the coin drop for reducing the overall dimensions thereof.

Nicholson et al, in U.S. Pat. No. 4,437,558 issued Mar. 20, 1984, teach coin testing apparatus which is mounted on a C-shaped bracket and which can be attached to a mounting surface. In this coin testing apparatus, coins are shown entering the coin test area along a substantially vertical path near the rear wall of the C-shaped bracket and are shown leaving the coin test area in a substantially vertical path. There is no teaching of coins entering a coin test area along a generally horizontal path adjacent the front of the assembly and immediately entering a coin test area closely adjacent the front of the coin testing apparatus.

While the prior art has shown coin testing mechanisms using induction coils, there has been no teaching of a coin drop assembly wherein coins are inserted along a horizontal path into a vertically disposed coin receiving slot and immediately enter and traverse a coin test area positioned between the face plate and the induction coils of the coin testing assembly.

SUMMARY OF THE INVENTION

It is therefore an object of the instant invention to provide an improved coin drop assembly.

It is a further object of the instant invention to provide a coin drop assembly having induction coin sensing means rearwardly spaced from the face plate and a coin test area between the face plate and the coin sensing means.

Briefly, the instant invention achieves these objects in a coin drop assembly including a face plate having a first coin slot for receiving coins and a second coin slot for returning other than a predetermined acceptable coin. A support member is mounted on and extends rearwardly from the face plate. Coin sensing apparatus includes induction coils which are supported on the support member and rearwardly spaced from the face plate. The coin sensing apparatus is operable for determining the acceptability of coins inserted into the first coin slot. A coin guide is provided for guiding the inserted coin rearwardly and downwardly from the first coin slot along a predetermined path between the face plate and the induction coils. First structure below the induction coils defines a coin accept chute for the predetermined acceptable coin. Second structure below the induction coils defines a coin reject chute communicating with the second coin slot for other than the predetermined acceptable coin. The coin sensing apparatus includes circuitry responsive to the induction coils for providing a signal representative of the acceptability of the inserted coin. Mechanism is provided which is responsive to the circuitry for directing the inserted coin to one of the coin accept chute and the coin reject chute.

Operation of the coin drop assembly and further objects and advantages thereof will become evident as the description proceeds and from an examination of the accompanying eight sheets of drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
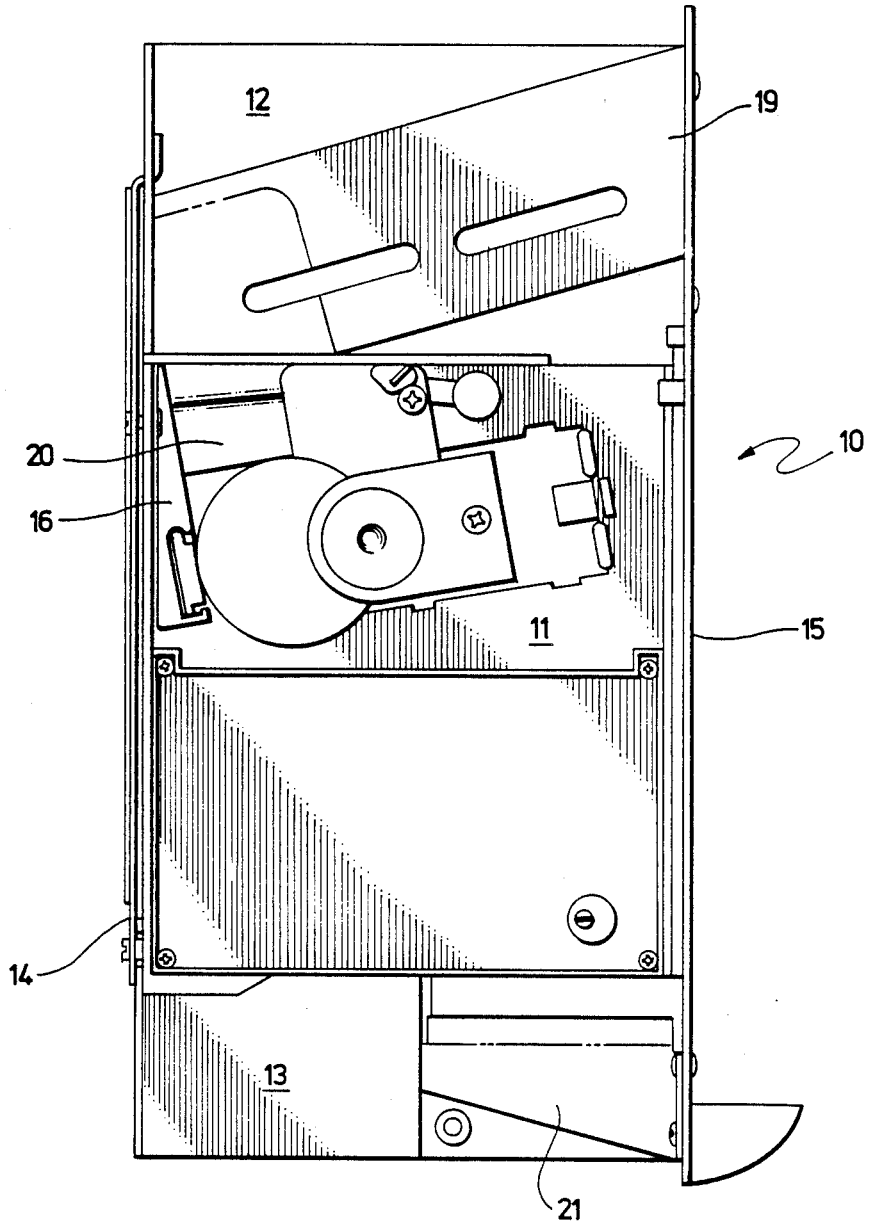
FIG. 1 (PRIOR ART)
FIGS. 1 and 2 are side elevation views of a prior art coin drop mechanism.
Figure 2:
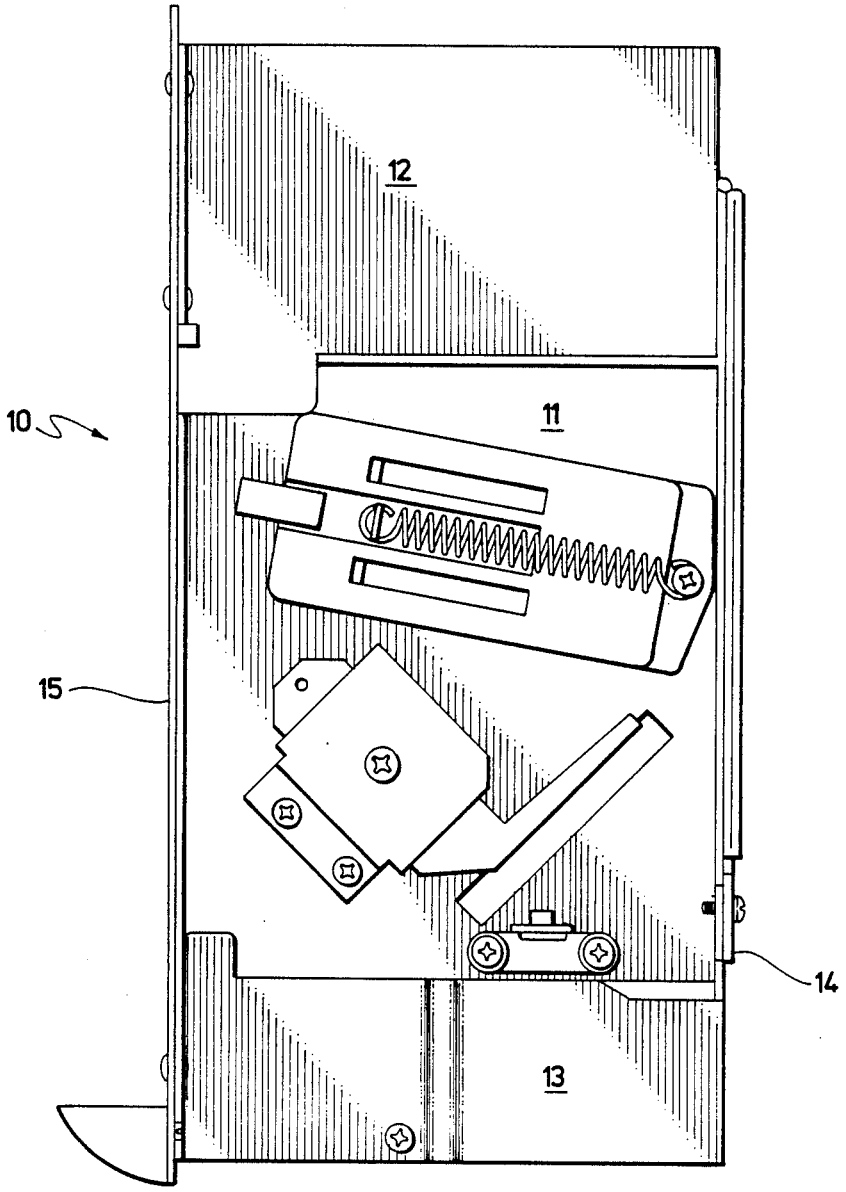
FIG. 2 (PRIOR ART)

Referring now to the drawings and in particular to FIGS. 1 and 2, there are shown left and right side elevation views respectively of a commercial coin drop mechanism 10 which includes coin testing apparatus substantially as shown in the alternate embodiment of Nicholson et al, U.S. Pat. No. 4,437,558, cited herein. In this prior art embodiment, the C-shaped bracket 11 mounting the coin testing apparatus of 4,437,558 is secured between upper and lower walls 12 and 13 which are riveted to a face plate 15. The rear of the walls 12 and 13 are tied together by a strap 14.

It is noted that in this prior art construction a coin guide rail 16 is mounted near the rear of the assembly and a coin entry chute 19 transports coins from the face plate 15 to the rear of the C-shaped bracket 11 where the coins drop vertically into a coin testing region 20. The lower wall 13 of this prior art mechanism includes a separate coin return chute 21 which is riveted thereto.

It can be readily seen that the prior art coin drop mechanism 10 shown in FIGS. 1 and 2 becomes physically larger and requires increased vertical mounting space by the rearward positioning of the coin testing region 20 which necessitates a relatively long coin entry chute 19 and a coin return chute 21 that is spaced below the coin testing apparatus. As a size comparison, the prior art coin drop mechanism 10 is approximately twice as tall as the coin drop assembly 30 of the instant invention.

Figure 3:
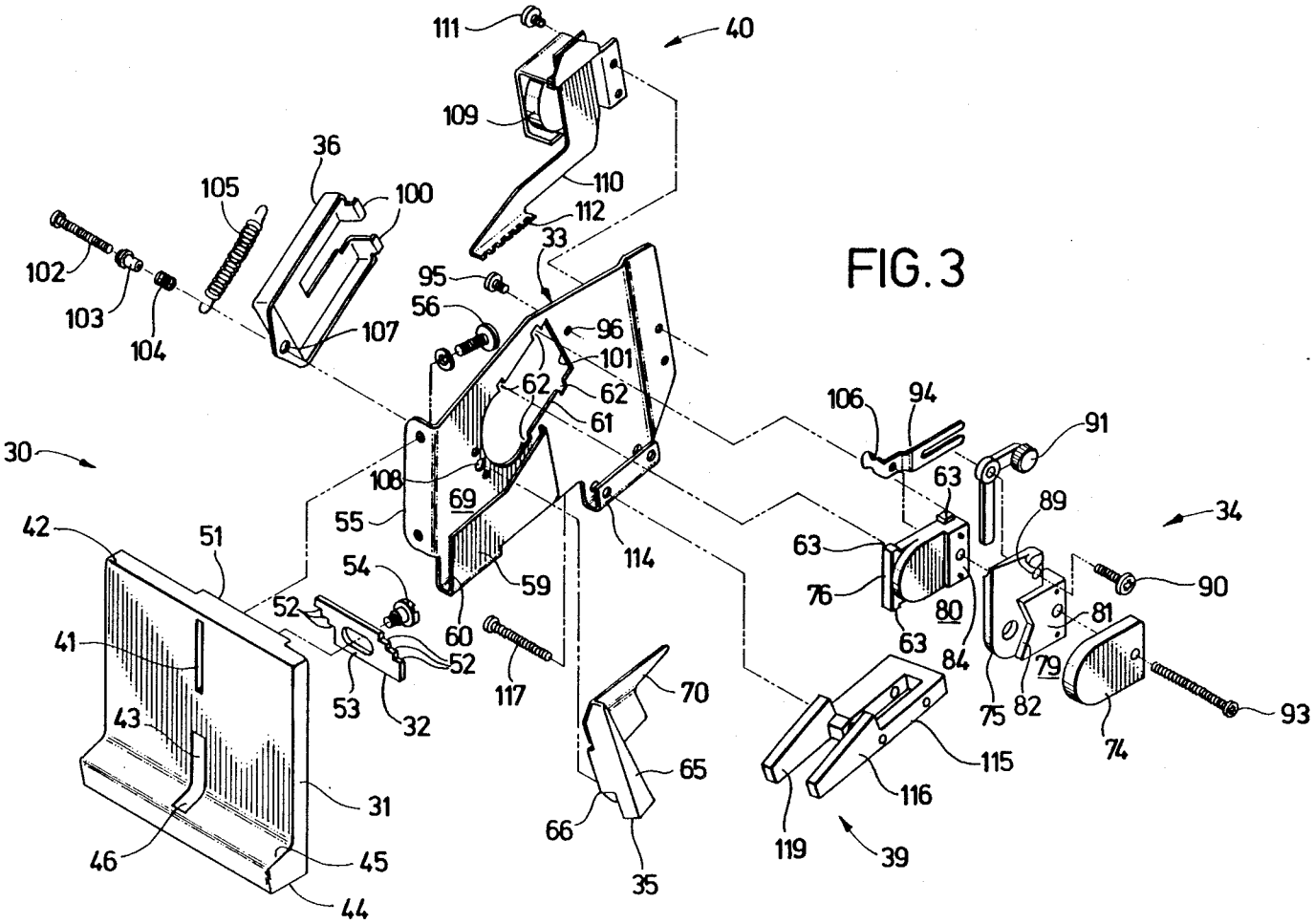
FIG. 3 is an exploded isometric view of the coin drop assembly of the instant invention.
Figure 4:
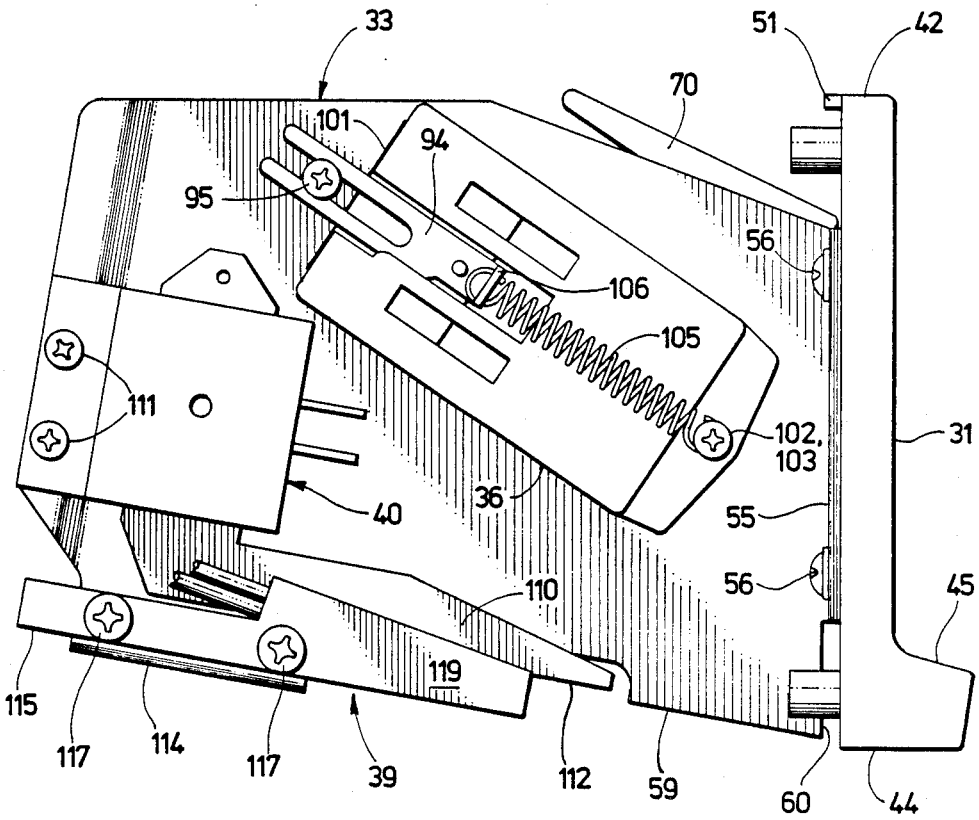
FIG. 4 is an elevation view of one side of the coin drop assembly.
Figure 5:
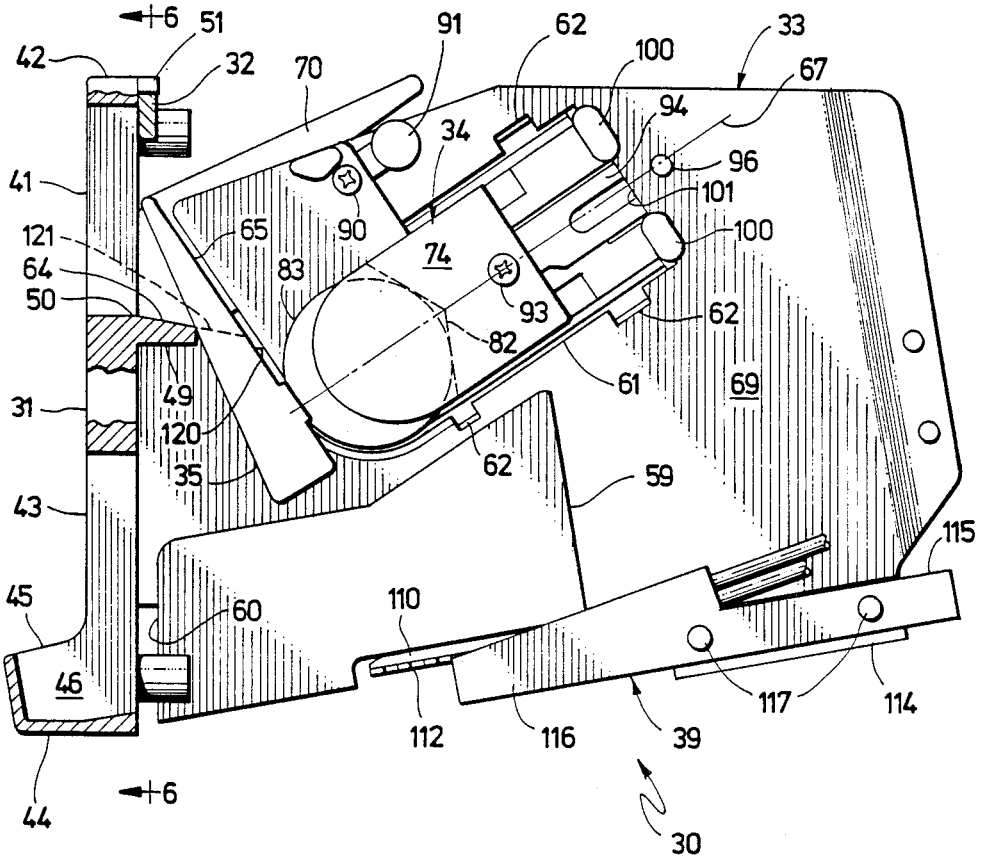
FIG. 5 is an elevation view of the other side of the coin drop assembly with portions of the face plate sectioned.

Turning now to FIGS. 3–5, there is shown the coin drop assembly 30 of the instant invention. As will be explained herein, the present coin drop assembly 30 comprises a plurality of separate parts and subassemblies. The coin drop assembly 30 includes a face plate 31, a coin gage 32, a support bracket 33, a coil assembly 34, a coin guide rail 35, a shield 36, an optics assembly 39 and a deflector arm assembly 40.

It should be understood that the coin drop assembly 30 as described herein may be adapted for use with a plurality of standard coin vaults such as found in the coin operated article vending, coin operated car wash and coin operated laundry industries. Most of these industries have, in the past, utilized coin slides which generally occupy less vertical mounting space than prior art constructions such as shown in FIGS. 1 and 2. The coin drop assembly 30, on the other hand, directly interchanges with a coin slide. Further, it is intended that the term "coin" should include all common U.S. coin denominations plus all foreign coins and miscellaneous tokens and checks which may be used in place of money.

Referring again to FIGS. 3–5, it can be seen that the front elevation configuration of the face plate 31 is generally square. The face plate 31 includes a coin receiving slot 41 generally centrally located on its side-to-side width near the top margin 42 and extending through the material thickness of the face plate 31. A coin return slot 43 is spaced below the coin receiving slot 41 adjacent the bottom margin 44 of the face plate 31. The lower portion of the face plate 31 has a forwardly extending shelf 45 across the width thereof and the coin return slot 43 extends forwardly into the shelf 45 to define a coin holding pocket 46 as best shown in FIGS. 5 and 7.

Figure 6:
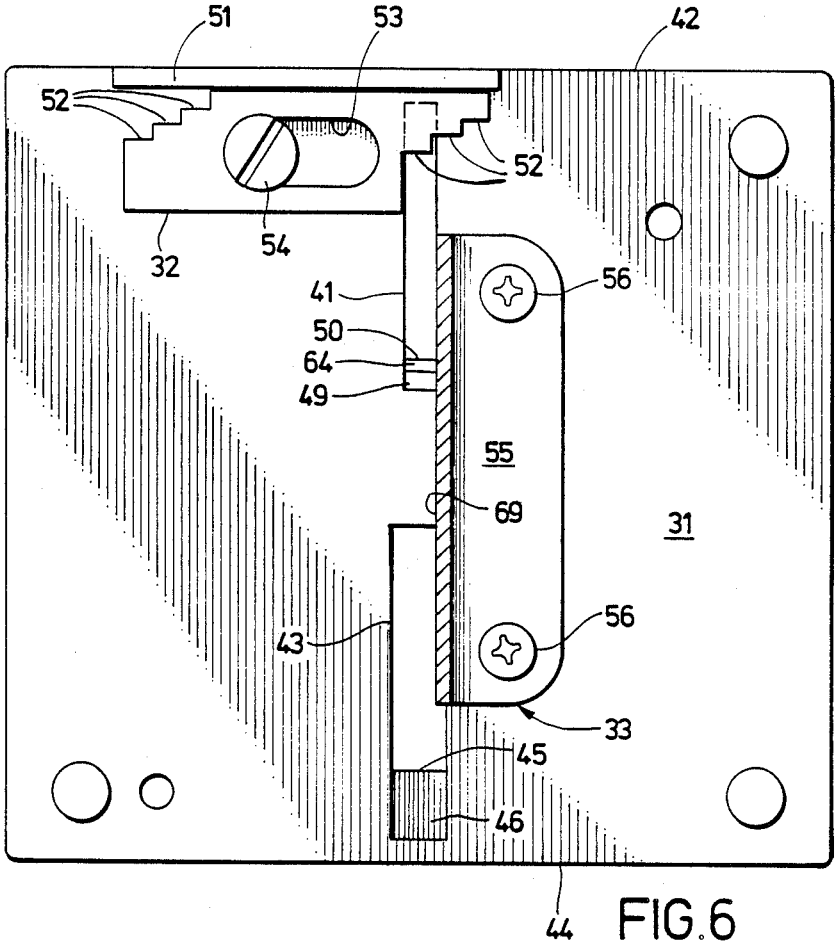
FIG. 6 is a view taken generally along lines 6—6 of FIG. 5.
Figure 7:
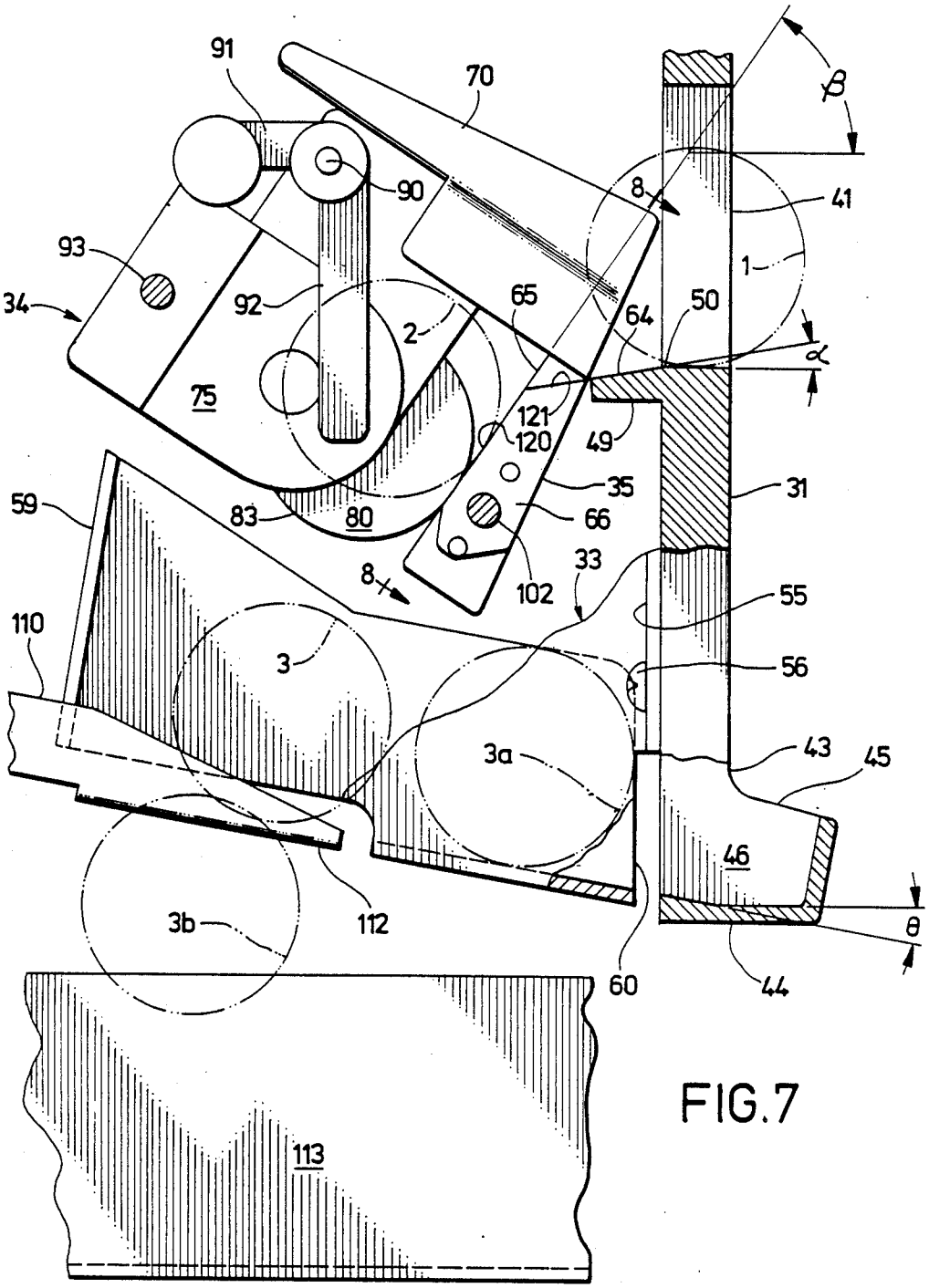
FIG. 7 is a partial fragmentary view similar to FIG. 4 with portions of the support bracket removed to better show the coin guide rail adjacent the rear of the face plate.

As further shown in FIGS. 5–7, the face plate 31 includes a projection 49 which extends rearward and downward from the bottom edge 50 of the coin receiving slot 41. The purpose of this projection 49 will be further described herein.

A narrow generally horizontal wall 51 projects rearward from the top margin 42 of the face plate 31. This wall 51 extends over the coin receiving slot 41 and provides an antiturn restraint for the coin gage 32 which is secured to the rear of the face plate 31 as best shown in FIG. 6. The coin gage 32 is a rectangular member having a plurality of step-like segments 52 corresponding to a predetermined range of coin diameters. The coin gage 32 includes a horizontal slot 53 as shown in FIGS. 3 and 6 for permitting side-to-side sliding movement on a shouldered screw 54. By aligning the proper step-like segment 52 with the coin receiving slot 41, a preliminary gaging of the diameter of the coin can be accomplished prior to the coin passing through the coin receiving slot 41.

Returning again to FIGS. 3–5, in this embodiment the support bracket 33 is formed from sheet metal but could alternatively be molded from a thermoplastic material. The support bracket 33 is generally rectangular and has a substantially vertical attachment flange 55 along the forward edge. The support bracket 33 is attached to the rear of the face plate 31 by a pair of fasteners 56 which extend through the attachment flange 55 and into threaded apertures in the rear surface of the face plate 31. The support bracket 33 extends rearward and is generally perpendicular to the face plate 31. As best shown in FIGS. 3 and 5, the right side 69 of the support bracket 33 includes a coin return or reject chute 59 integrally formed from the sheet metal of the support bracket 33. The coin return chute 59 is spaced below the coin receiving slot 41, extends downward and forward toward the rear of the face plate 31 with an exit end 60 juxtaposed to the coin return slot 43.

As further shown in FIG. 3, the support bracket 33 includes an upward and rearward extending elongated opening 61 for mounting the coil assembly 34 as will be further discussed herein. The opening 61 has a plurality of cut-outs 62 for receiving retaining tabs 63 associated with the coil assembly 34. The upper rear of the coin return chute 59 is spaced a predetermined distance below the opening 61 so that when the coil assembly 34 is attached to the support bracket 33, there will be sufficient clearance to allow coins from a preselected range of coin diameters to pass through the coil assembly 34 and traverse the coin return chute 59.

Figure 8:
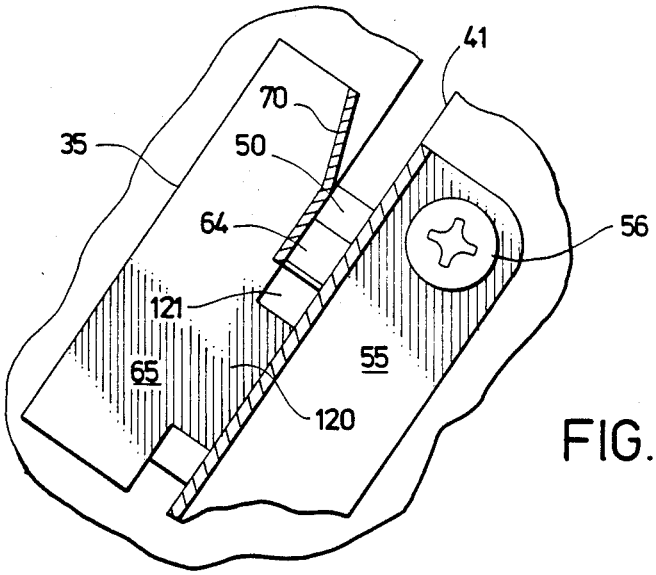
FIG. 8 is a partial fragmentary section view taken generally along lines 8–8 of FIG. 7 with the support bracket in place and shown out of order with FIG. 6.

The coin guide rail 35, as shown in FIGS. 3, 5, 7 and 8, is a wedge-like block of molded or similarly formed thermoplastic which is mounted on the right side 69 of the support bracket 33 as viewed from the front of the face plate 31. The coin guide rail 35 is mounted so that the side 65 of the right triangle, which defines the profile of the coin guide rail 35, is generally perpendicular to the central axis 67 of the upward and rearward extending opening 61 in the support bracket 33 as shown in FIG. 5. The surface or side 66 of the coin guide rail 35 is contiguous with the right side 69 of the support bracket 33 and includes a notch 121 which provides an extension of the inlet ramp 64 formed by the projection 49 for guiding coins toward the coin test surface 120 formed by the side 65. The coin guide rail 35 and the face plate 31 are thus cooperable for providing a coin path which is closely adjacent the rear of the face plate 31. A side wall 70 is molded into the wedgelike block and extends generally parallel to the support bracket 33 and to one edge of the coin receiving slot 41 for stabilizing coins as they travel along the projection 49. As best shown in FIG. 8, the side wall 70 in combination with the support bracket 33 effectively defines a rearward and downward extension of the coin receiving slot 41.

Returning to FIG. 3, there is shown the coil assembly 34 which mounts in the upwardly and rearwardly extending opening 61 of the support bracket 33. The coil assembly 34 comprises first, second and third coils 71–73, shown schematically in FIG. 9. The coils 71–73 are encapsulated in thermoplastic housings 74–76 respectively. When the housings 74–76 are assembled in a side-by-side fashion generally identical gaps or spaces 79 and 80 are provided between the first and second coils 71 and 72 and second and third coils 72 and 73. The housing 75 encapsulating the second coil 72 includes a shoulder 81 for providing the gap 79 between the first and second coils 71 and 72. The shoulder 81 further includes a V-shaped wall 82 for receiving the diametrical edge of a sample coin 83 as best shown in FIG. 5. The housing 76 of the third coil 73 has a shoulder 84 which provides the gap 80 between the second and third coils 72 and 73. The housing 76 of the third coil 73 further includes a pair of upper and a pair of lower retaining tabs 63 which are cooperable with the cut-outs 62 of the opening 61 for movably mounting and retaining the coil assembly 34 therein. Once the coil assembly 34 has been mounted to the support bracket 33, it is movable in a direction parallel to the central axis 67 of the opening 61 and perpendicular to the plane of side 65. The housing 75 of the second coil 72 includes an aperture 89 in the upper right-hand corner as viewed in FIG. 3 for receiving a threaded fastener 90. A bell crank shaped pendulum member 91 pivots on the fastener 90 and is captured between the second and third coils 72 and 73 with the arm 92 extending into the gap 80 between these coils 72 and 73, as best shown in FIG. 7, to slow movement of coins dropping through the gap 80.

To secure the three coil housings 74–76 as a coil assembly 34 and provide the generally identical gaps 79 and 80, a threaded fastener 93 extends through the housings 74–76 and threads into one end of a lock bracket 94. The other end of the lock bracket 94 is bifurcated and a locking screw 95 passes through the bifurcation and into aperture 96 in the support bracket 33. This action will lock the coil assembly 34 in place after a sample coin 83 has been positioned in the gap 79 between first and second coils 71 and 72 with the coin edge trapped by the V-shaped wall 82 and the coin guide rail 35 as shown in FIG. 5.

As best shown in FIGS. 3–5, a thermoplastic shield 36 is assembled over the opening 61 in the support bracket 33 to hold the coil assembly 34 parallel to the support bracket 33 and protect that portion of the coil assembly 34 which extends through the opening 61. The shield 36 has a pair of tabs 100 which engage with the upper rear end 101 of the opening 61. A threaded fastener 102 extends through a bushing 103 and compression spring 104 and through apertures 107 and 108 in the shield 36 and the support bracket 33 respectively before tapping into the side 66 of the coin guide rail 35.

Once the coil assembly 34 and shield 36 are in place, an extension spring 105 is stretched between the bushing 103 and an upstanding lug 106 associated with the lock bracket 94 as best shown in FIG. 4. The extension spring 105 biases the coil assembly 34 toward the coin guide rail 35 and assures that when a sample coin 83 is placed in the first gap 79 it will be securely wedged between the V-shaped wall 82 and side 65 of the coin guide rail 35. Final tightening of the locking screw 95 will secure the lock bracket 94 and coil assembly 34 to the support bracket 33 to prevent undesired movement of the coil assembly 34 such as by probes or pry bars inserted into the coin receiving slot 41.

Mounted at the rear of the support bracket 33, as shown in FIGS. 3 and 4, is a deflector arm assembly 40 including a deflector arm operating coil 109 and an L-shaped deflector arm 110. The deflector arm assembly 40 is secured to the support bracket 33 by a pair of threaded fasteners 111. The L-shaped deflector arm 110 extends forwardly and generally parallel to the bottom of the support bracket 33. The extreme forward end of the L-shaped deflector arm 110 has a right angle wall member 112 which extends under the support bracket 33 to form part of the bottom wall of the coin return chute 59. When the operating coil 109 is electrically energized, the deflector arm 110 is retracted creating a void in the bottom of the coin return chute 59 allowing the coin to drop into a coin storage receptacle 113 as shown in FIG. 7. Conversely, if the operating coil 109 is not energized the deflector arm 110 will direct the coin toward the coin return slot 43.

Referring again to FIGS. 3–5, the lower rear corner of the support bracket 33 has an upturned U-shaped channel 114 for mounting an optics assembly 39. As best shown in FIG. 3, a horseshoe-like bracket 115 is attached to the U-shaped channel 114 by fasteners 117 to place a first LED portion 116 of the optics assembly 39 on one side of the coin return chute 59 and a second photo detector portion 119 of the optics assembly 39 on the other side of the coin return chute 59 so that coins passing into the coin storage receptacle 113 will interrupt a light path between the first LED portion 116 and the second photo detector portion 119.

Turning now specifically to FIG. 7, there is shown the geometric relationship of the face plate 31 coin guide rail 35, coil assembly 34 and coin chute 59 of one embodiment of the instant invention which provides for a compact coin test area with all coin travel occurring closely adjacent the rear of the face plate 31. The side 65 of the right triangle which defines the coin guide rail 35 forms the coin test surface 120 through the gap 80 between the second and third coils 72 and 73 and is oriented at an acute angle beta from the horizontal plane. As best shown in FIG. 5, the central axis 67 of the opening 61 is generally perpendicular to the side 65 of the right triangle and is disposed at an acute angle with respect to the substantially vertical plane of the face plate 31. The coin inlet and return paths are disposed at angles alpha and theta respectively from the horizontal plane but in opposite directions for guiding coins toward and away from the coin test surface 120. It is to be understood that the coin drop assembly 30 will perform satisfactorily over a range of angles alpha, beta and theta selected to permit gravitational movement of coins.

Coins enter the coin receiving slot 41 along a generally horizontal path as depicted in FIG. 7 by phantom coin outline 1. As shown by phantom coin outline 1, the coins are placed immediately into a coin guide path formed by the projection 49 and notch 121. The rearwardly and downwardly extending projection 49 of the face plate 31 guides the coin rearward and downward to the mating inlet ramp portion formed by the notch 121 of the coin guide rail 35. Phantom coin outline 2 shows a coin on the coin test surface 120 of the coin guide rail 35 between the coil assembly 34 and the face plate 31. Phantom coin outline 3 depicts the coin after passing over the coin test surface 120. If the coin has been detected to be invalid, it will be directed toward the coin return slot 43 as shown by phantom coin outline 3*a*. If the coin is determined to be valid, the operating coil 109 will be energized as the coin leaves the test surface 120 to move the deflector arm 110 and permit the coin to move past the optics assembly 39 to the coin strage receptacle 113 as indicated by phantom coin outline 3*b*.

Figure 9:
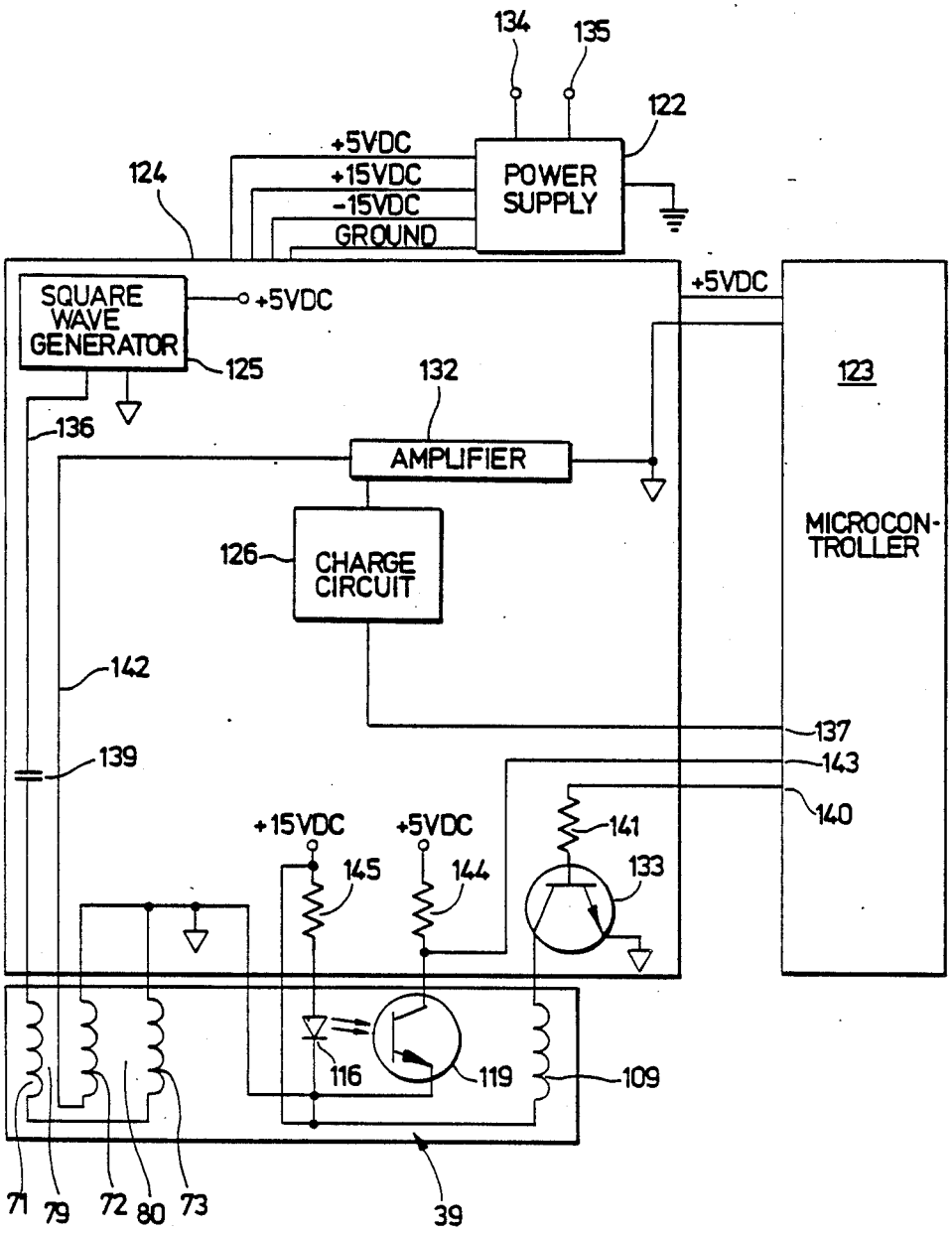
FIG. 9 is an electrical schematic drawing of the coin test circuitry.

Referring now to FIG. 9, there is shown a partial electrical schematic circuit for the coin drop assembly 30 described herein. The circuit includes a power supply 122, a microcontroller 123 such as an NEC Electronics UPD7519, a circuit board 124 including a square wave generator 125 based on a National Semiconductor LM 1458 dual operational amplifier, a charge circuit 126, a National Semiconductor LM 741 operational amplifier used as an amplifier 132, and a transistor 133 for energizing the operating coil 109 for the deflector arm 110. Also included in the schematic circuit are components physically mounted on the coin drop assembly 30 such as first, second and third coils 71–73, the LED and photo detector portions 116 and 119 of the optic switch and the operating coil 109 for the deflector arm 110.

The power supply 122 rectifies a 110 VAC 60 hertz input at lines 134 and 135 and outputs a plus 5 VDC, a plus 15 VDC, and a minus 15 VDC to the circuit board 124 for supplying related components as shown in FIG. 9. The square wave generator 125 outputs a 7000 hertz square wave signal. This output is imposed on line 136 which has a capacitor 139 in series with first and third coils 71 and 73. The first coil 71 emits a magnetic field to the second coil 72 and the third coil 73 emits an equal and opposite magnetic field to the second coil 72. Any inequality in the permeability of the two gaps or spaces 79 and 80 between the coils 71–73 generates a signal at the second coil 72. Conversely, when the permeability of the gaps 79 and 80 are generally equal, indicating that two identical coins are fully engaged in the gaps 79 and 80, a null signal is present at the second coil 72.

The signal from the second coil 72 is fed by line 142 to the amplifier 132 which provides both filtering and amplification. When a sample coin 83 is present in the first gap 79 and no test coin is in the second gap 80, the charge circuit 126 of FIG. 9 is charged. When a sample coin 83 is present and an identical test coin passes along the coin test surface 120, there is a null signal and the charge circuit 126 is discharged. The voltage from the charge circuit 126 is monitored by the microcontroller 123 at port 137. When only a sample coin 83 is present, the output of charge circuit 126 will be approximately a plus 12.5 VDC. As a test coin that is nearly identical to the sample coin 83 passes along the coin test surface 120, the voltage at port 137 is reduced to very near zero VDC. Once the microcontroller 123 is satisfied that a valid coin has passed between coils 72 and 73, it will set port 140 to a high state to energize the operating coil 109 by way of the resistor 141 and the transistor 133 for moving the deflector arm 110.

The optics assembly 39 is provided as a means of preventing illegal use of a valid coin, such as by attaching a string to the coin and repeatedly actuating the coin sensing circuitry. The microcontroller 123 checks to insure that the coin enters and leaves the optics assembly 39 toward the coin storage receptacle 113 in an appropriate time frame by way of port 143. The photo detector portion 119 of the optics assembly 39 is powered by plus 5 VDC through a resistor 144 and the LED portion 116 is powered by plus 15 VDC through a resistor 145.

The instant invention provides an improved coin drop assembly having a coin test area between the coil assembly and the face plate. The location adjacent the face plate and abbreviated length of the coin test area allows the coin drop assembly to be dramatically reduced in overall size and permits interchangeability with coin slide mechanisms. The coin drop assembly of the instant invention allows the use of induction coin testing in applications where modification of the existing coin vault to accept prior art induction coin drops is not possible. The improved coin drop assembly provides for the use of induction coin sensing apparatus in the relatively small confines of coin vaults previously designed for use with coin slide mechanisms.

In the drawings and specification there has been set forth a preferred embodiment of the invention and although specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as defined in the following claims.

I claim:

1. A coin drop assembly, comprising: a face plate having first slot means for receiving coins including a predetermined acceptable coin and second slot means for returning other than said predetermined acceptable coin; slot modifying means on said face plate including a gage plate having formed structure corresponding to a predetermined range of coin diameters and movable with respect to said first slot means for modifying said first slot means to prevent acceptance of coins exceeding the diameter of said predetermined coin; support means mounted on and extending rearwardly from said face plate; coin sensing means operable for determining the acceptability of a coin inserted into said first slot means and including induction coin means supported on said support means rearwardly spaced from said face plate; coin guide means including a first coin support portion extending rearward and downward at a first angle relative to said face plate and a second coin support portion extending rearward and downward at a second steeper angle for guiding said inserted coin from said first slot means along a predetermined path between said face plate and said induction coil means; first means below said induction coil means defining a coin accept chute for said predetermined acceptable coin; second means below said induction coil means defining a coin reject chute communicating with said second slot means responsive to said induction coil means for providing a signal representative of the acceptability of said inserted coil; and means responsive to said circuit means for directing said inserted coin to one of said coin accept chute and said coin reject chute.

2. A coin drop assembly as defined in claim 1 and further including locking means cooperable with said induction coil means and said support means for locking said induction coil means in a non-movable posture.

3. A coin drop assembly, comprising: a face plate having first slot means for receiving coins including a predetermined acceptable coin and second slot means for returning other than said predetermined acceptable coin; gage means having a plurality of steplike segments and cooperable with said first slot means to provide an initial diameter check of said inserted coin; support means mounted on and extending rearwardly from said face plate; coin sensing means operable for determining the acceptability of a coin inserted into said first slot means and including induction coil means on said support means and rearwardly spaced from said face plate; coin guide means for guiding said inserted coin rearwardly and downwardly along a predetermined path between said face plate and said induction coil means including a first coin support portion extending rearward and downward at a first angle relative to said face plate and a second coin support portion extending rearward and downward at a second steeper angle; and means including chute means for accepting said predetermined acceptable coin and rejecting other than said predetermined acceptable coin.

4. A coin drop assembly, comprising: a face plate having first slot means for receiving coins including a predetermined acceptable coin and second slot means for returning other than said predetermined acceptable coin; gage means adjacent said first slot means and including a plurality of step-like segments cooperable with the top of said first slot means and selectively adjustable with respect thereto to selectively change the effective height thereof for providing an initial diameter check of a coin inserted into said first slot means; support means mounted on and extending rearwardly from said face plate; coin sensing means operable for determining the acceptability of a coin inserted into said first slot means and including induction coil means supported on said support means rearwardly spaced from said face plate; locking means cooperable with said induction coil means and said support means for locking said induction coil means to said support means to prevent movement of said coil means; coin guide means including a first coin support portion disposed at a first rearward and downward angle relative to said face plate and a second coin support portion disposed at a second steeper rearward and downward angle for guiding said inserted coin from said first slot means along a predetermined path between said face plate and said induction coil means; first means below said induction coil means defining a coin accept chute for said predetermined acceptable coin; second means below said induction coil means defining a coin reject chute communicating with said second slot means for other than said predetermined acceptable coin, said coin sensing means further including circuit means responsive to said induction coil means for providing a signal representative of the acceptability of said inserted coin; and means operable responsive to said signal for directing said inserted coin to one of said coin accept chute and coin reject chute.

* * * * *

UNITED STATES PATENT AND TRADEMARK OFFICE

CERTIFICATE OF CORRECTION

PATENT NO. : 4,984,670

DATED January 15, 1991

INVENTOR(S) : Scott A. Merkle

It is certified that error appears in the above-identified patent and that said Letters Patent is hereby corrected as shown below:

| | |
|---|---|
| Col. 6, line 38 | "strage" should be -- storage -- |
| Col. 8, line 3 | "coin" should be -- coil -- |
| Col. 8, line 16 | after "means" insert -- for other than said predetermined acceptable coin, said coin sensing means further including circuit means -- |
| Col. 8, line 18 | "coil" should be -- coin -- |

Signed and Sealed this

Twenty-ninth Day of October, 1991

*Attest:*

HARRY F. MANBECK, JR.

*Attesting Officer*

*Commissioner of Patents and Trademarks*